US011230913B2

(12) United States Patent
Klie et al.

(10) Patent No.: US 11,230,913 B2
(45) Date of Patent: Jan. 25, 2022

(54) POWER LOSS DYSFUNCTION CHARACTERIZATION

(71) Applicant: CONOCOPHILLIPS COMPANY, Houston, TX (US)

(72) Inventors: Hector M. Klie, Houston, TX (US); Phil D. Anno, Houston, TX (US); Stacey C. Ramsay, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 719 days.

(21) Appl. No.: 15/152,242

(22) Filed: May 11, 2016

(65) Prior Publication Data

US 2016/0333672 A1 Nov. 17, 2016

Related U.S. Application Data

(60) Provisional application No. 62/160,886, filed on May 13, 2015.

(51) Int. Cl.
*E21B 44/04* (2006.01)

(52) U.S. Cl.
CPC ..... *E21B 44/04* (2013.01)

(58) Field of Classification Search
CPC ..... E21B 44/04
USPC ..... 703/10, 2
See application file for complete search history.

(56) References Cited

U.S. PATENT DOCUMENTS 5,115,872 A 5/1992 Brunet et al.
7,921,937 B2 * 4/2011 Brackin ..... E21B 44/005 175/107
8,731,888 B2 * 5/2014 Yin ..... G06F 17/5009 250/250
10,120,343 B2 11/2018 Chiu et al.
10,345,771 B2 7/2019 Anno et al.
D868,801 S 12/2019 Anno et al.
(Continued)

FOREIGN PATENT DOCUMENTS

WO 2015/026317 A1 2/2015

OTHER PUBLICATIONS

Hiltunen et al., "UV-imprinted single-mode waveguides with low loss at visible wavelength", 2013, IEEE Photonics Technol. Lett. 25.10 , pp. 996-998.*
(Continued)

*Primary Examiner* — Juan C Ochoa
(74) *Attorney, Agent, or Firm* — Polsinelli PC

(57) ABSTRACT

The invention relates to a method, system and apparatus for determining real-time drilling operations dysfunctions by measuring the power-loss of signal propagation associated with a drill string in a wellbore. The invention comprises acquiring a first time series from a mid-string drilling sub sensor associated with a drill string in a wellbore and acquiring a second time series from a sensor associated with the drill string wherein the sensor is on or near a drill rig on the surface of the earth. The process further comprises determining the geometry of the wellbore and determining model parameters alpha and beta for characterizing a wellbore using the first time series, the second time series and the geometry of the wellbore by deriving a power loss of signal propagation. The model parameters may then be used for drilling a subsequent well using surface sensor acquired data to detect drilling dysfunctions.

20 Claims, 7 Drawing Sheets

(56) References Cited

U.S. PATENT DOCUMENTS

| | | | | |
|---|---|---|---|---|
| D869,498 | S | 12/2019 | Anno et al. | |
| D880,524 | S | 4/2020 | Anno et al. | |
| 10,655,453 | B2 | 5/2020 | Chiu et al. | |
| D886,122 | S | 6/2020 | Anno et al. | |
| D890,188 | S | 7/2020 | Anno et al. | |
| D891,450 | S | 7/2020 | Anno et al. | |
| 10,788,801 | B2 | 9/2020 | Anno et al. | |
| 10,907,464 | B2 | 2/2021 | Zha et al. | |
| 2002/0120401 | A1 | 8/2002 | MacDonald et al. | |
| 2004/0154831 | A1* | 8/2004 | Seydoux | E21B 7/04 175/24 |
| 2012/0120763 | A1 | 5/2012 | Vu et al. | |
| 2014/0149098 | A1* | 5/2014 | Bowen | E21B 43/26 703/10 |
| 2016/0160639 | A1* | 6/2016 | Dudley | E21B 47/12 340/853.2 |
| 2016/0341027 | A1* | 11/2016 | Kyllingstad | E21B 7/04 |

OTHER PUBLICATIONS

Jon Bang et al., "Wellbore Tortuosity Analysed by a Novel Method May Help to Improve Drilling, Completion, and Production Operations", Mar. 2015, SPE/IADC Drilling Conference and Exhibition, Society of Petroleum Engineers, pp. 1-16.*

International Search Report, Form PCT/ISA/210 dated Aug. 11, 2016. PCT Application No. PCT/US2016/031864, International Filing Date—May 11, 2016, ConocoPhillips Company—Applicant.

Sheppard, M.C., et al.—"Designing Well Paths to Reduce Drag and Torque", 1987, SPE Drilling Engineering, pp. 344-350; 7 pgs.

Gambling, W.A., et al—"Measurement of radiation loss in curved single-mode fibres", 1978, Microwaves, Optics and Acoustics, vol. 2, No. 4, Jul. 1978, pp. 134-140; 7 pgs.

Remouche, Mustapha, et al—"Flexible Optical Waveguide Bent Loss Attenuation Effects Analysis and Modeling Application to an Intrinsic Optical Fiber Temperature Sensor", 2012, Optics and Photonics Journal, vol. 2, Issue 1-7, Scientific Research, pp. 1-7; 7 pgs.

Gambling, W.A., et al—"Curvature and microbending losses in single-mode optical fibres", 1979, Optical and Quantum Electronics 11, pp. 43-59; 17 pgs.

Dikken, Dirk Jan, et al—"Characterization of bending losses for curved plasmonic nanowire waveguides", 2010, Optics Express, vol. 18, No. 15; 8 pgs.

Johnson, Michael J., et al—Robust measures of three-dimensional vascular tortuosity based on the minimum curvature of approximating polynomial spline fits to the vessel mid-line, 2007, Medical Engineering & Physics, vol. 29, Science Direct, Elsevier, pp. 677-690; 14 pgs.

Samuel, Robello, et al—"Wellbore Tortuosity, Torsion, Drilling Indices, and Energy: What do They have to do with Well Pat Design?", 2009, SPE International, Society of Petroleum Engineers 124710, Paper submitted at 2009 SPE Annual Technical Conference and Exhibition held in New Orleans, Louisiana Oct. 4-7, 2009; pp. 1-14; 14 pgs.

* cited by examiner

POWER LOSS DYSFUNCTION CHARACTERIZATION

CROSS-REFERENCE TO RELATED APPLICATIONS

This application is a non-provisional application which claims benefit under 35 USC § 119(e) to U.S. Provisional Application Ser. No. 62/160,886 filed May 13, 2015, entitled "POWER LOSS DYSFUNCTION CHARACTERIZATION," which is incorporated herein in its entirety.

STATEMENT REGARDING FEDERALLY SPONSORED RESEARCH OR DEVELOPMENT

None.

FIELD OF THE INVENTION

The present invention relates generally to detection and mitigation of drilling dysfunctions. More particularly, but not by way of limitation, embodiments of the present invention include predicting real-time dysfunctions at any location of a drill string by modeling a wellbore environment to enable recovery of signal energy from a drill string under operating conditions that allows for the detection and mitigation of downhole drilling dysfunctions, dysfunctions detected by sensors on the surface.

BACKGROUND OF THE INVENTION

Hydrocarbon reservoirs are developed with drilling operations using a drill bit associated with a drill string rotated from the surface or using a downhole motor, or both using a downhole motor and also rotating the string from the surface. A bottom hole assembly (BHA) at the end of the drill string may include components such as drill collars, stabilizers, drilling motors and logging tools, and measuring tools. A BHA is also capable of telemetering various drilling and geological parameters to the surface facilities.

Resistance encountered by the drill string in a wellbore during drilling causes significant wear on drill string, especially often the drill bit and the BHA. Understanding how the geometry of the wellbore affects resistance on the drill string and the BHA and managing the dynamic conditions that lead potentially to failure of downhole equipment is important for enhancing efficiency and minimizing costs for drilling wells. Various conditions referred to as drilling dysfunctions that may lead to component failure include excessive torque, shocks, bit bounce, induced vibrations, bit whirl, stick-slip, among others. These conditions must be rapidly detected so that mitigation efforts are undertaken as quickly as possible, since some dysfunctions can quickly lead to tool failures.

Rapid aggregation and analysis of data from multiple sources associated with well bore drilling operations facilitates efficient drilling operations by timely responses to drilling dysfunctions. Accurate timing information for borehole or drill string time-series data acquired with down hole sensors are important for aggregating information from surface and down hole sensors. However, each sensor may have its own internal clock or data from many sensors may be acquired and recorded relative to multiple clocks that are not synchronized. This non-synchronization of the timing information creates problems when combining and processing data from various sensors. Additionally, sensor timing is known sometimes to be affected by various environmental factors that cause variable timing drift that may differentially impact various sensors. Many factors may render inaccurate the timing of individual sensors that then needs to be corrected or adjusted so the data may be assimilated correctly with all sensor information temporally consistent in order to accurately inform a drilling operations center about the dynamic state of the well being drilled.

Downhole drilling dysfunctions can cause serious operational problems that are difficult to detect or predict. The more rapidly and efficiently drilling dysfunctions are identified the more quickly they may be mitigated. Thus a need exists for efficient methods, systems and apparatuses to quickly identify and to mitigate dysfunctions during drilling operations.

BRIEF SUMMARY OF THE DISCLOSURE

It should be understood that, although an illustrative implementation of one or more embodiments are provided below, the various specific embodiments may be implemented using any number of techniques known by persons of ordinary skill in the art. The disclosure should in no way be limited to the illustrative embodiments, drawings, and/or techniques illustrated below, including the exemplary designs and implementations illustrated and described herein. Furthermore, the disclosure may be modified within the scope of the appended claims along with their full scope of equivalents.

The invention more particularly includes in non-limiting embodiments a process for determining real-time drilling operations dysfunctions by measuring the power-loss of signal propagation associated with a drill string in a wellbore, the process comprises acquiring a first time series from a mid-string drilling sub sensor associated with a drill string in a wellbore in a first well and acquiring a second time series from a sensor associated with the drill string wherein the sensor is on or near a drill rig on the surface of the earth. The process further comprises determining the geometry of the wellbore and determining model parameters alpha and beta for characterizing a wellbore using the first time series, the second time series and the geometry of the wellbore by deriving a power loss of signal propagation.

In another non-limiting embodiment, a system is provided for determining real-time drilling operation dysfunctions by measuring power-loss of signal propagation associated with a drill string during drilling a wellbore where the where the system comprises a mid-string drilling sub sensor associated with a drill string in a wellbore in a first well for acquiring a first time series and a sensor associated with the first well drill string for acquiring a second time series wherein the sensor is on a drilling rig or near the surface of the earth. A bottom hole assembly associated with the drill string provides data to determine a geometry of the first wellbore, while a first computer program module determines model parameters alpha and beta that characterize a wellbore using the first time series, the second time series and the geometry of the wellbore by deriving a power loss of signal propagation.

In still further non-limiting embodiments a drilling rig apparatus is provided for drilling multiple wells, where the apparatus comprises a drill rig with a first drill string for drilling a first well and a mid-string drilling sub sensor associated with the drill string for acquiring a first time series, as well as a second sensor associated with the drill string wherein the second sensor is on or near the drill rig at the surface of the earth, the second sensor for acquiring a second time series. Also provided is a bottom hole assembly associated with the drill string to provide data to determine a geometry of a wellbore. A first computer program module is provided for determining model parameters, using the first time series, the second time series and the geometry of the wellbore to derive model parameters alpha and beta that characterize a power loss of signal propagation for signal travelling through the drill string.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

The following examples of certain embodiments of the invention are given. Each example is provided by way of explanation of the invention, one of many embodiments of the invention, and the following examples should not be read to limit, or define, the scope of the invention.

Figure 1:
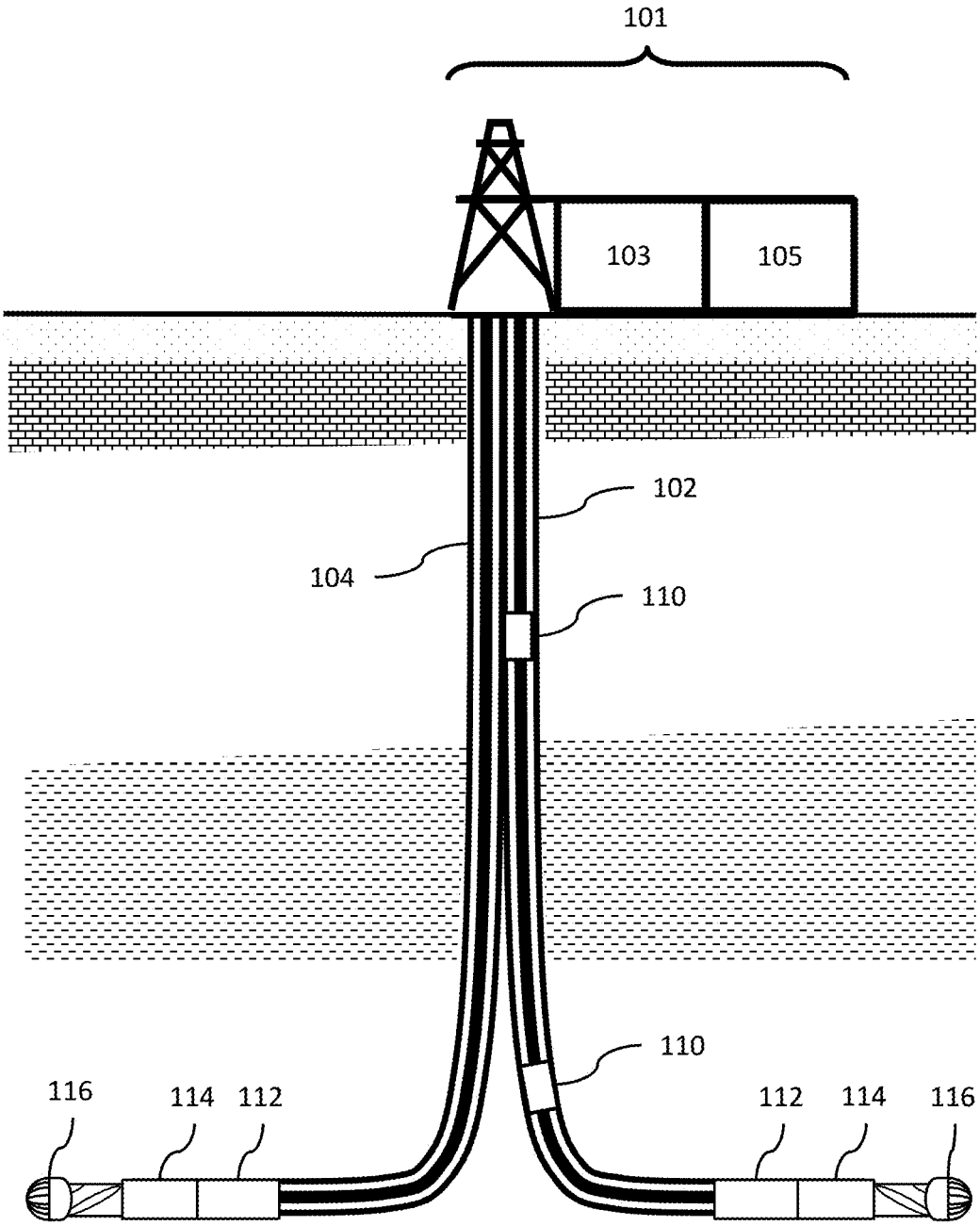
FIG. 1 illustrates an example of a subterranean formation with a first wellbore and a second wellbore according to various embodiments of the present disclosure.

FIG. 1 illustrates an example of a subterranean formation with a first wellbore and a second wellbore according to various embodiments of the present disclosure. The various embodiments disclosed herein are used in the well drilling environment as illustrated in FIG. 1 wherein a well bore 102 is drilled from surface drilling rig facilities 101 comprising a drilling rig, drill string associated sensors, 103, to obtain data telemetered in the drill string from within the wellbore, for example an electronic acoustic receiver attached on the Kelly or blow-out preventer, as well as associated control and supporting facilities, 105, which may include data aggregation, data processing infrastructure including computer systems as well as drilling control systems. During drilling operations the well bore 102 includes a drill string comprising an associated bottom hole assembly (BHA) that may include a mud motor 112, an adjustable bent housing or 'BHA Dynamic Sub' 114 containing various sensors, transducers and electronic components and a drill bit 116. The BHA Dynamic Sub acquire time series data such as RPM, torque, bending moment, tension, pressure (ECS) and vibration data. Additionally, the BHA acquires measurement-while-drilling and logging-while-drilling (MWD/LWD) data in high fidelity or standard modes, such as inclination, azimuth, gamma ray, resistivity and other advanced LWD data. Any data acquired with the BHA may be transmitted to the drilling rig 101 through drill string telemetry or through mud-pulse telemetry as time series data.

The drill string may also contain associated sensors, for example mid-string dynamic subs 110 that acquire high fidelity time series data such as RPM, torque, bending moment, tension and vibration data, and these instrumented subs can send signals representing these measurements by telemetry up the drill string where they are also recorded on or near the drilling rig.

In various embodiments, it is possible to increase the efficiency for drilling a subsequent well by providing the results acquired drilling the first wellbore 102 to be used in drilling of a second wellbore, such as wellbore 104 of FIG. 1. As disclosed herein, using the model parameters determined from drilling a first wellbore 102, where an instrumented mid-string dynamic subs 110 were used, the instrumented subs will not be required for wellbore 104, since sensors associated with the drill string for wellbore 104, which sensors are on or near the rig on the surface of the earth, combined with the geometry information and other time series data received by telemetry from the BHA associated with the drill string for the second wellbore, are all that are required to determine the downhole dynamics associated with the drilling operations, so that dysfunctions may be detected and mitigated effectively.

Embodiments disclosed herein provide for predicting real-time drilling dysfunctions at any location of a drill string. The various embodiments disclosed herein provide advantages that include: (a) simplicity to detect and model a wide range of possible power losses through only three parameters; (b) determinations of down hole conditions that are well posed and amenable to stable estimation of parameters at different scales; (c) flexibility for use with different bending functions and signal representations (e.g., mean, envelope values); (d) efficiency for predicting dysfunctions by way of power-loss determinations at any point in time/depth, and therefore useful for measuring and understanding dynamic downhole conditions through measurements acquired at the surface drilling facilities associated with the drill string, so that similarly situated wells may drilled without using mid-string dynamic subs and only using surface acquired data to characterize the dynamic downhole environment during drilling operations.

In drilling operations, sensors are placed at different wellbore locations, drill string locations and time/depth intervals to provide real-time measurements such as revolutions per minute (RPM), torques, weight on bit (WOB) and accelerations, etc. The data acquired with these sensors may be irregularly distributed and subject to transmission losses due to absorption, scattering, and leakage induced by bending effects of the well trajectory. The nonlinear combination of these effects causes an important attenuation or power-loss of signal amplitudes that may compromise the integrity and prediction of dysfunctions taking place at multiple sections of the drill string along a wellbore.

An understanding of the laws governing the power-loss along the wellbore is therefore key to enable detection and control mechanisms that may mitigate undesirable vibrations or other conditions and prevent eventual bit or BHA failures. The present invention provides a simple but powerful power-loss model that predicts the decay of the signal energy under arbitrary bending effects due to the geometries of the well bore. An understanding of the power-loss along the wellbore provided by the power-loss model facilitates an understanding of the dynamic downhole conditions, including dysfunctions, as the well is being drilled.

The power-loss model depends on a set of 3 parameters: one parameter, alpha ($\alpha$), for controlling losses along the vertical section (i.e., regardless of bending effects) and two parameters, beta ($\beta$) and gamma ($\gamma$), that controls the trade-off between exponential and hyperbolic signal decays for a given bending function or wellbore geometry.

The power-loss model combines analogs of slab (rigid) and fiber (soft) model losses that are similar to models proposed in Optics [Hunsperger, 2009] and Photonics [Pollock, 2003]. The presently disclosed embodiments comprise, but are not limited to, three different bending functions relative to wellbore geometries that may be described by mathematical relationships using $\alpha$, $\beta$ and $\gamma$: 1) a geometrical tortuosity, 2) cumulative dog-leg and 3) clamping efficiency.

Borehole tortuosity is inherent to drilling and is the undulation from the planned well bore trajectory, such as spiraling in vertical sections or a slide-rotary behavior in horizontal sections. A dog-leg is a crooked place in a wellbore where the trajectory of the wellbore deviates from a straight path. A dog-leg may be created intentionally in directional drilling to turn a wellbore to a horizontal path, for example with nonconventional shale wells. The standard calculation of dogleg severity is expressed in two-dimensional degrees per 100 feet, or degrees per 30 meters, of wellbore length.

The increasing use of sensors in real-time downhole operations is useful to investigate the wellbore environment during the drilling process and to measure the actual geometry of the wellbore. The possibilities for modeling power-loss of signals travelling up the drill string as a result of wellbore geometry may now be addressed in instrumented drilling practices. The models are generally governed by exponential decay functions. These functions may adopt different forms to accommodate different types of materials, to capture other loss sources on bending geometries such as those produced by micro-bending and sudden or relatively rapid changes in curvature.

Advantages of the bending function models disclosed herein include: (a) simplicity to accommodate a wide range of possible losses through various mathematical descriptions using combinations of three model parameters, herein designated as $\alpha$, $\beta$ and $\gamma$; (b) a well posed model or model group that is amenable to stable estimation of its parameters at different scales; (c) flexibility to be used with different bending functions and signal representations (e.g., mean, envelope values); and (d) efficiency for predicting dysfunction using the power-loss at any point in time/depth along the drill string leading to efficient and timely dysfunction mitigation.

Low-frequency surface data, such as RPM, weight-on-bit (WOB), torque on bit (TOB) and acceleration data are routinely used to discover and mitigate drilling dysfunctions. However, recent developments in recording high-frequency surface and downhole data adds a new dimension to better understand drilling dysfunctions. Wave optics and photonics literature provide analogs useful for understanding transmission losses such as absorption, scattering and leakage through different materials that are subject to bending effects, such as are imposed by the geometries within a wellbore.

In general, a loss that is due to curvature and other geometrical considerations in the well bore may be described by: $P(z)=P(0)\cdot e^{-az}$, where P is power loss, z is depth and a is propagation of signal strength in the drill string, so that $$a = -\frac{1}{P(z)}\frac{dP(z)}{dz}.$$

Assuming that all propagation constants can be combined together and phase effects omitted, the signal propagation, a may be expressed as $a=\alpha\cdot e^{-\beta\cdot R}$ (for the slab case, useful for modeling over relatively short distances) and as $a=\alpha\cdot R^{-1/2}e^{-\beta\cdot R}$ (for the fiber case, useful for modeling over larger distances) where R is the radius of curvature, $\alpha$ is a situationally dependent magnitude constant, $\beta$ and $\gamma$ are parameters related to bending or radius in an exponential or hyperbolic sense.

Various embodiments of the present disclosure provide a Hybrid Slab/Fiber Model for Power-Loss. The disclosed model includes an exponential coefficient that decays as a mix of exponential and hyperbolic trends from a bending model wherein $$P(z=0)=P(z)\cdot e^{-a(\tau)z}=P(z)\cdot e^{-\alpha e^{-\beta\tau}\tau^{-\gamma}z}$$

where $\tau$≡clamping efficiency. Note that for $\tau\cong 0 \Rightarrow P(z=0)=P(z)\cdot e^{-a\cdot z}$, which is the standard attenuation model on a straight domain, such as the initial vertical section of the well bore construction.

The two-step parameter estimation: (1) $\ln(P_{0,i}/P_{i,j})+a_i z_i=0$ for $i=1, 2, \ldots, N_z$; $j=1, 2, \ldots, N_s$ and (2) $a_i=\alpha e^{-\beta\tau_i}\tau_i^{-\gamma}$, being the three-parameter problem to account for combined slab/fiber effects where i is the index over depth and j indexes over survey stations.

The implementation of various preferred embodiments for characterizing or modeling the power-loss dysfunction includes an option to select or model a selected bending function (i.e., geometrical tortuosity, dog-leg and clamping efficiency). Also, options to experiment with different fitting options may be derived using these model parameters. In addition, it is possible to define fitting geometries from any given starting depth. There are also definitions provided by applications of the model parameters for different smoothing and filtering options. Slab and fiber models are available to estimate power-loss by inversion using a combination of surface sensor time series data compared to equivalent down hole sensor time series data. Regressions can be performed on data for any sensor or aggregated data from some or all sensors.

Figure 2:
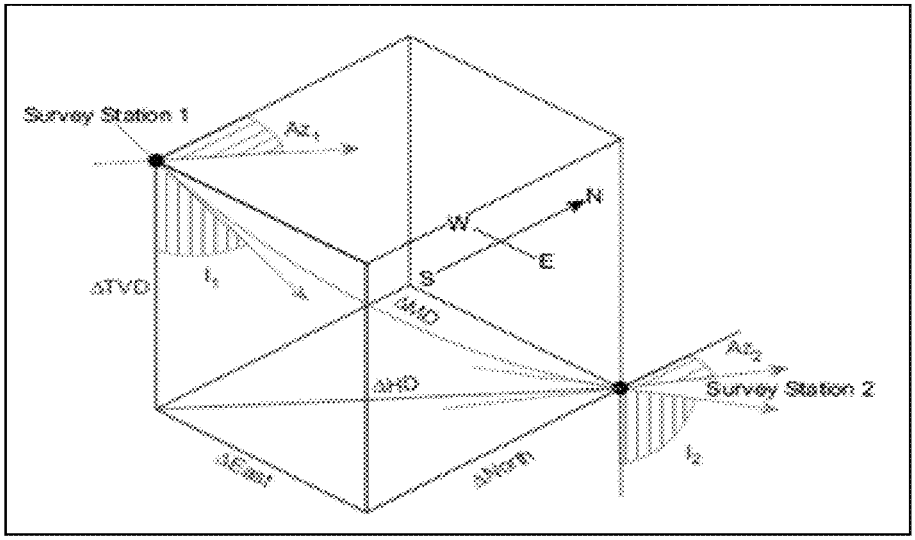
FIG. 2 illustrates terms used for the description of the geometrical tortuosity of a wellbore.

The geometrical tortuosity bending function, $\delta$, may be given by $$\delta_k \equiv 1 - \frac{l_k}{z_k} = 1 - \frac{\|TVD_k, NS_k, EW_k\|_2}{MD_k},$$

where $l_k$ is an idealized length from one subsurface survey station position to the next subsurface survey station position and $z_k$ is the actual distance along the actual geometry length of the drilled wellbore. The numerator and denominator of the last term of this equation is illustrated in FIG. 2. The cumulative dogleg bending function, $\delta$, is given by:

$$\delta_k = \arccos(\cos(i_{1,k})\cdot\cos(i_{2,k}) + \sin(i_{1,k})\cdot\sin(i_{2,k})\cdot\cos(Az_{2,k} - Az_{1,k}))\cdot\frac{100}{MD_k}.$$

As illustrated in FIG. 2 the geometrical tortuosity bending function, $\vartheta$, from Survey Station 1 to Survey Station 2 is measured two ways, which comprise the numerator $\|TVD_k, NS_k, EW_k\|_2$ and the denominator $MD_k$. The denominator is the actual geometry as measured along the wellbore between Survey Station 1 and Survey Station 2, for example using data acquired from a BHA, while the numerator is the idealized measurement based on the square root of the sum of the squares of the vertical distance ($TVD_k$), the North to South distance ($NS_k$) and the East to West distance ($EW_k$), also taking into consideration the azimuth $Az_1$ and inclination $I_1$ of the drill string at Survey Station 1 and the azimuth $Az_2$ and inclination $I_2$ of the drill string at Survey Station 2.

Figure 3:
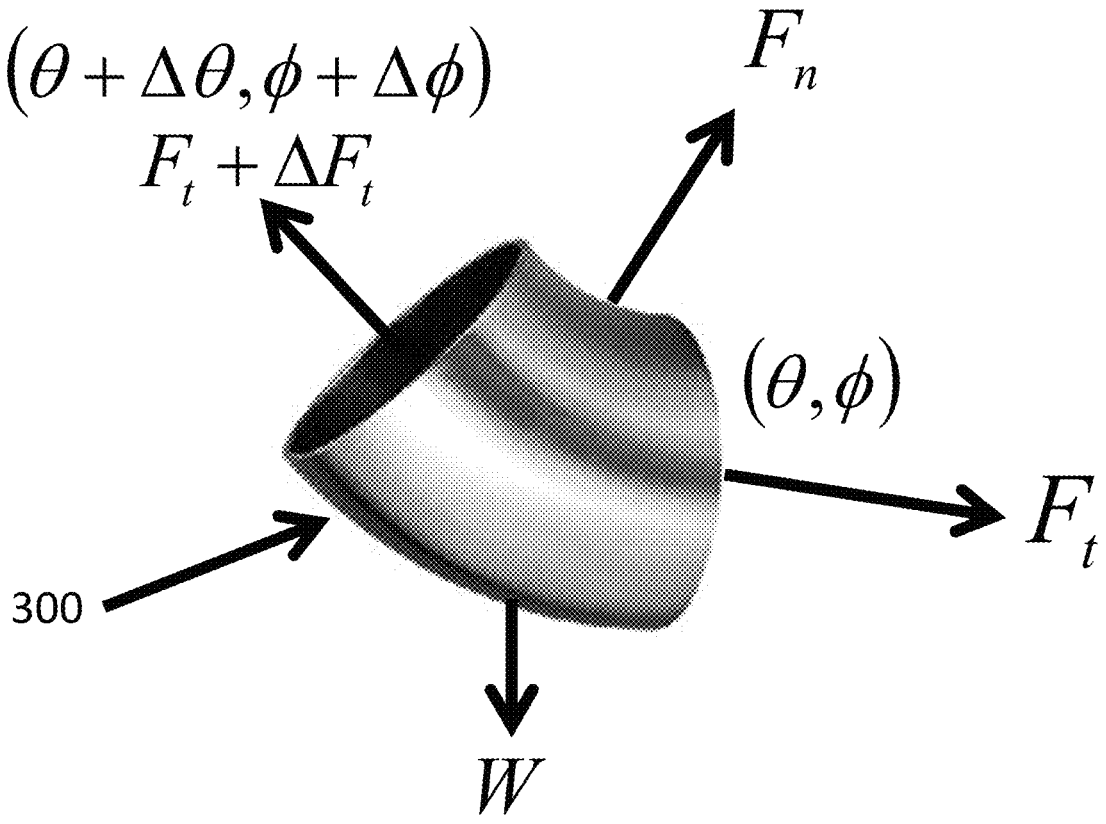
FIG. 3 illustrates terms used for the description of forces on a drillstring in a wellbore.

To further analyze a bending function in a wellbore, clamping efficiency parameters may be described in physics-based formulation where forces acting on the drill pipe are viewed as illustrated in FIG. 3 at the bend in the trajectory designated as (θ, Ø) inclination and azimuth, respectively. The force along the trajectory of the drill string is $F_t$, for the tensional or transverse forces on the drill string in the direction of the wellbore trajectory, while the force normal to the wellbore trajectory at that point is $F_n$. The force in the other directions from the trajectory of the drill string trajectory at the bend is $F_t+\Delta F_t$, which forces are associated directionally as (θ+ΔØ, α+ΔØ) due to the bending. The weight of the drill string is designated W. With these parameters the forces may be combined to describe the clamping efficiency, analogous to a form of resistance by the wellbore to the drilling operations due to the drill string's interaction with the wellbore geometry:

$$\tau^2 = \frac{F_n^2}{F_t^2} = (\Delta\phi\sin\theta)^2 + \left(\Delta\theta + \frac{W}{F_t}\sin\theta\right)^2 \approx (\Delta\phi\sin\theta)^2 + \Delta\theta^2.$$

Figure 4:
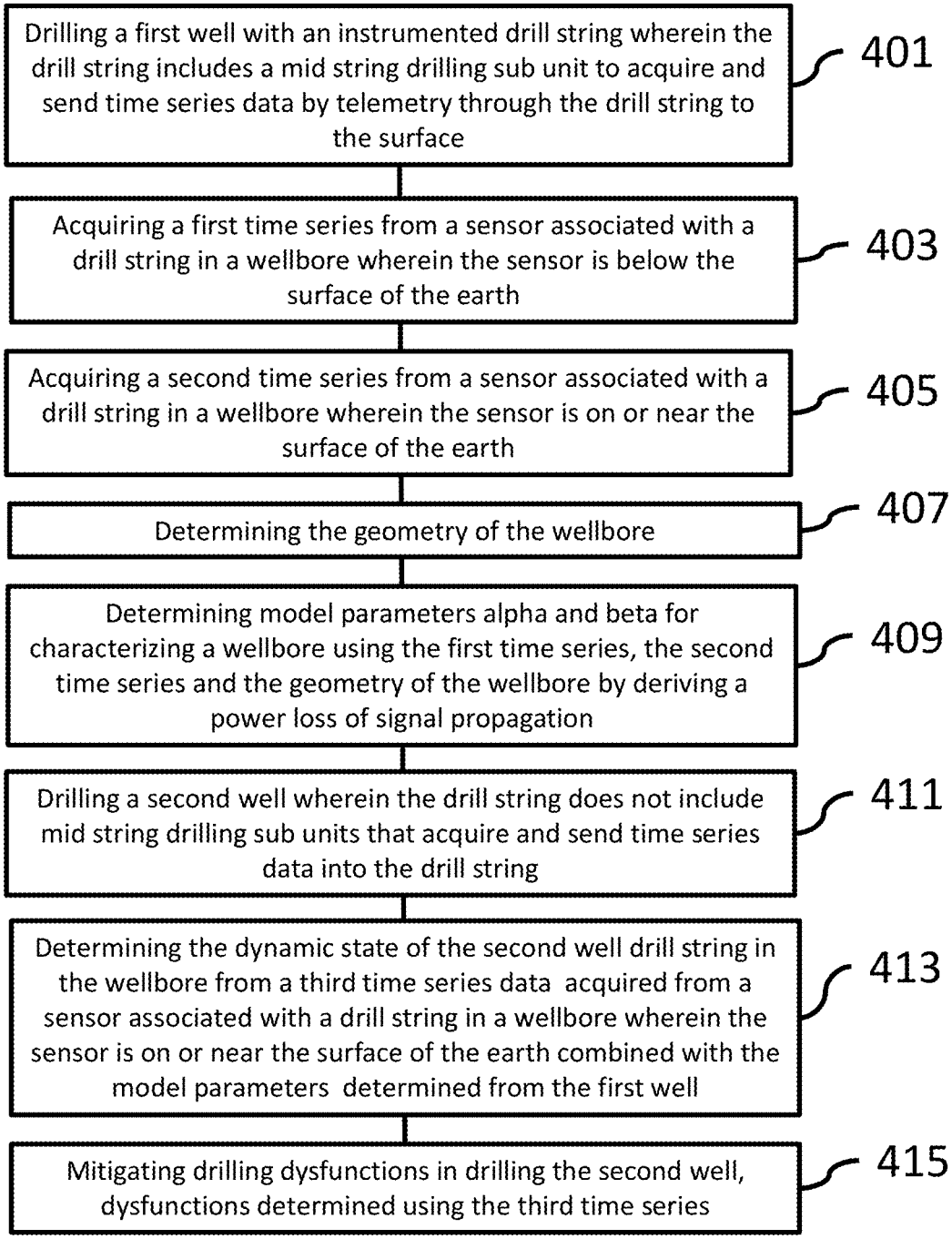
FIG. 4 illustrates a method according to embodiments of the present disclosure for determining real-time dysfunctions by measuring power-loss of signal propagation associated with a drill string.

FIG. 4 illustrates a process for determining real-time drilling dysfunctions by measuring power-loss of signal propagation associated with a drill string. A (first) well is drilled with an instrumented drill string wherein the drill string includes a mid-string drilling sub unit to acquire and send time series data by telemetry to the surface 401. A first time series is acquired from a sensor associated with a mid-string drilling sub unit in a wellbore wherein the sensor is below the surface of the earth 403. A second time series is acquired from a sensor associated with a drill string, the drill string in a wellbore, wherein the sensor associated with the drill string is on or near the surface of the earth, for example associated with an acoustic receiver attached to the Kelly or other rig component for acquiring the signal. A geometry of the wellbore is determined, 405, from data acquired from a bottom hole assembly that is telemetered to the surface. Model parameters that describe the wellbore signal propagation power losses due to geometrical effects are determined using the first time series, the second time series and the geometry of the wellbore to derive parameters alpha and beta that characterize a power loss of signal propagation for signal travelling through the drill string based on attenuation caused by the geometry of the wellbore 409 among other dynamic effects. The differential power-loss between various sensors at various locations may aid characterization. Analysis of the differential power-loss effects of various time-series comparison allows for detection and then mitigation of drilling dysfunctions. A second well may be drilled wherein the drill string does not include mid string drilling sub units that acquire and send time series data into the drill string 411. The dynamic state of a second well drill string in a second wellbore may be determined from a third time series data acquired from a sensor associated with a drill string in a wellbore, wherein the sensor is on or near the surface of the earth (i.e., associated with an acoustic sensor on the Kelly), and the third time series data are combined with BHA telemetered data and the model parameters determined from the first well 413. Drilling dysfunctions in drilling the second well may be detected and mitigated using the third time series 415, the model parameters derived from the first wellbore and the geometry of the second wellbore.

Figure 5:
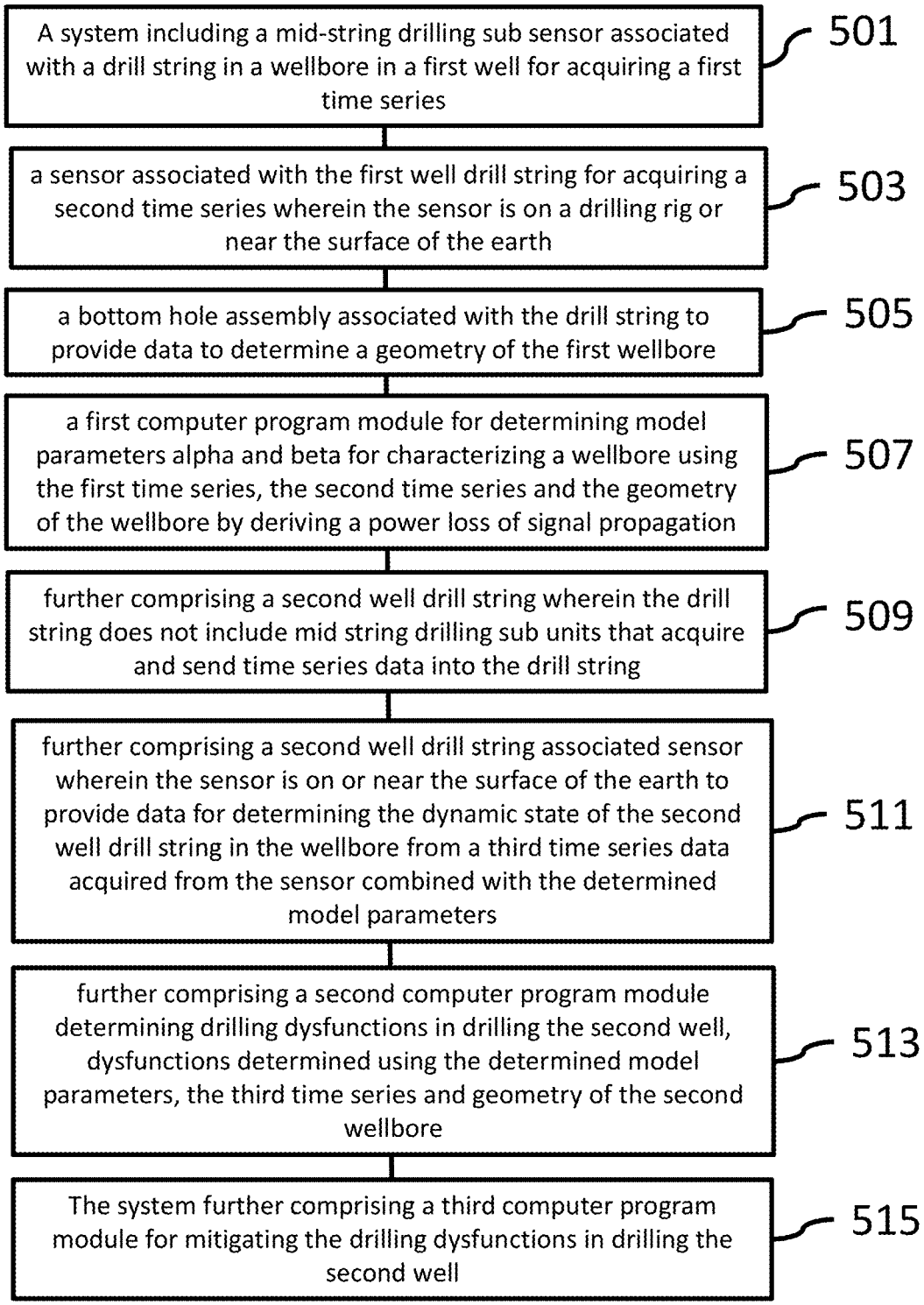
FIG. 5 illustrates a system according to embodiments of the present disclosure for modeling a wellbore environment.

FIG. 5 illustrates a system including a mid-string drilling sub sensor (110) associated with a drill string in a wellbore in a first well for acquiring a first time series 501. A sensor associated with the first well drill string for acquiring a second time series wherein the sensor is on a drilling rig or near the surface of the earth 503. A bottom hole assembly 112, 114, 116 associated with the drill string in a well bore 102 provides data to determine a geometry 505 of the first wellbore 102. A first computer program module determines model parameters, using the first time series, the second time series and the wellbore geometry, to derive model parameters alpha and beta that characterize a power loss for signal propagation signal travelling through the drill string, 507. Optionally, the system may further comprise a second well drill string in a well bore 104 wherein the drill string does not include mid string drilling sub units that acquire and send time series data into the drill string, 509. Optionally, the system may also further comprise a second well drill string associated sensor 103 wherein the sensor is on or near the surface of the earth (for example an acoustic sensor associated with the Kelly) to provide data for determining the dynamic state of the second well drill string in the wellbore from a third time series acquired from the sensor combined with the determined model parameters from the first well, 511. The system may further comprise a second computer program module determining drilling dysfunctions in drilling the second well, dysfunctions determined using the determined model parameters from the first well, the third time series and geometry of the second wellbore as derived from the BHA data associated with the second drill string, 513. The system may further comprise a third computer third computer program module for mitigating the drilling dysfunctions in drilling the second well 515.

Figure 6:
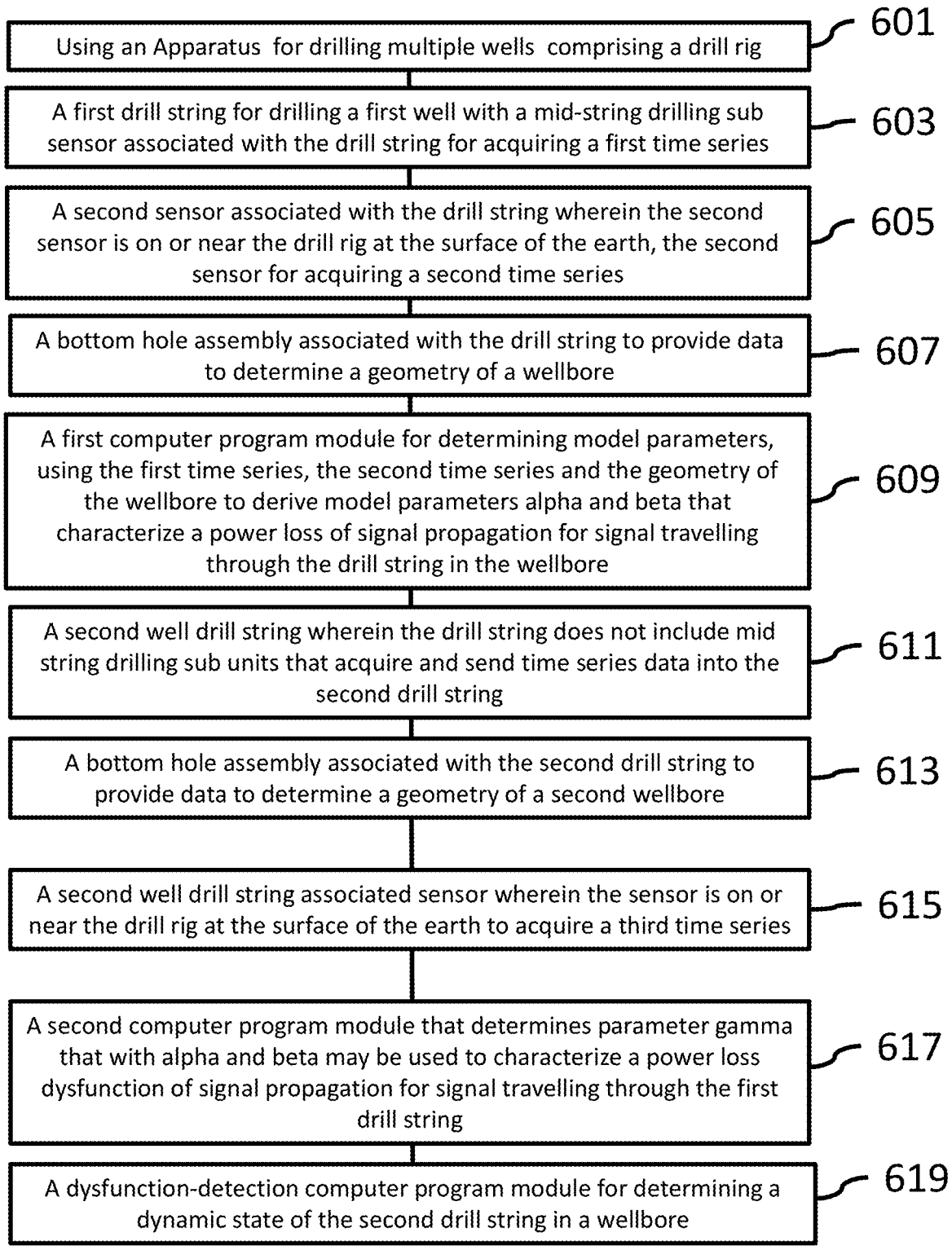
FIG. 6 illustrates an apparatus according to embodiments of the present disclosure for modeling a wellbore environment.

FIG. 6 illustrates the use of a drilling apparatus for drilling multiple wells 601 comprising a drill rig 101 with a first drill string in a well bore 102 for drilling a first well with a mid-string sub sensor 110 associated with the drilling string for acquiring a first time series 603. A second sensor 103 associated with the drill string in a well bore 102 wherein the second sensor is on or near the drill rig 101 at the surface of the earth, the second sensor for acquiring a second time series 605. A bottom hole assembly 112, 114, 116 is associated with the drill string to provide data to determine a geometry of a wellbore associated with drill string in a well bore 102. The apparatus comprises a first computer program module for determining model parameters, using the first time series, the second time series and the geometry of the wellbore to derive model parameters alpha and beta that characterize a power loss of signal propagation for signal travelling through the drill string in the wellbore 609. A second well may be drilling wherein the drill string does not include a mid-string drilling sub unit 611. A bottom hole assembly 112, 114, 116 may be associated with the second drill string in a well bore 104 to provide data to determine a geometry of a second wellbore 613 and to provide time series data for comparison with a drill string associated sensor on the surface 103, providing a third time series 615 in order to derive signal power loss along the drill string in the wellbore and to determine drilling dysfunctions as the well is being drilled. After deriving the parameters alpha and beta, these parameters may be used in the drilling of a second well wherein the geometry data of the second well, the third time series data (such as from sensor 103) combined with BHA time series data to derive power loss information related to the second wellbore may be inverted to detect and then mitigate drilling dysfunctions in drilling operations. In addition, a second computer program module may determine parameter gamma that with alpha and beta may be used to characterize a power loss of signal propagation for signal travelling in either the first or the second drill string. Using combinations of these parameters, a dysfunction detection computer program module may determine a dynamic state of the second drill string in a wellbore. When a drilling dysfunction is detected, measures may be taken to mitigate the dysfunction.

Figure 7:
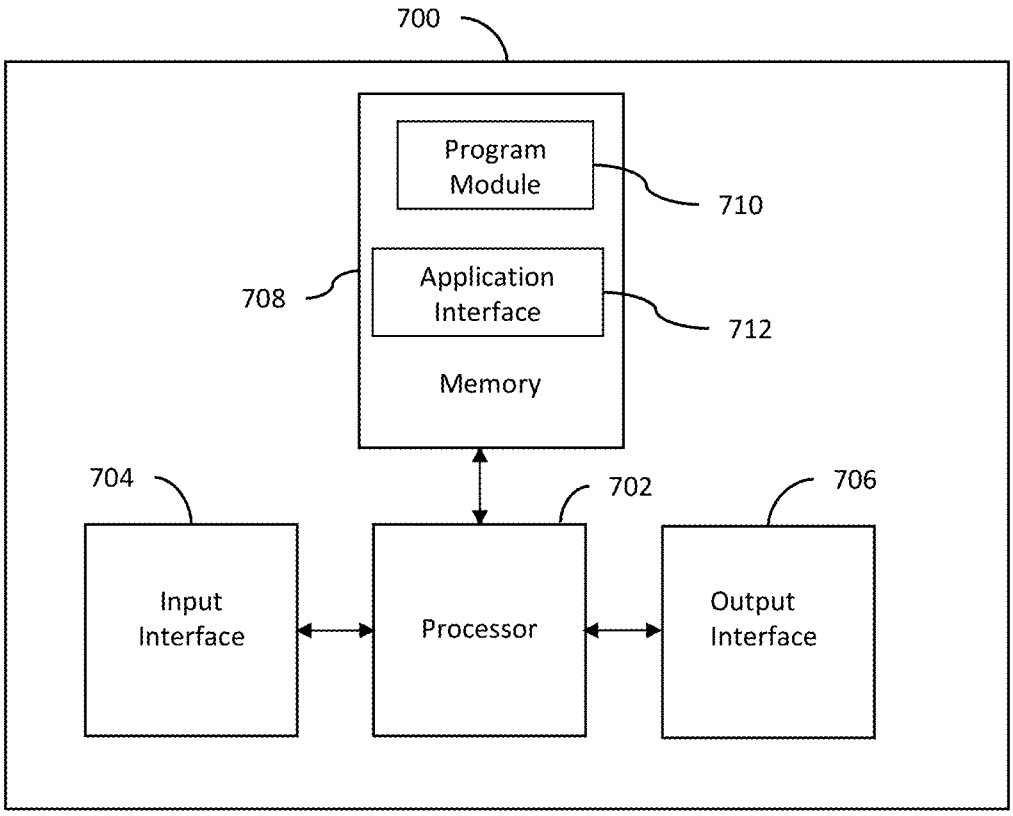
FIG. 7 illustrates a system or apparatus according to further embodiments of the present disclosure.

FIG. 7 is a schematic diagram of an embodiment of a system 700 that may correspond to or may be part of a computer and/or any other computing device, such as a workstation, server, mainframe, super computer, processing graph and/or database. System 700 may be associated with surface infrastructure facilities 105 on a drilling rig 101. The system 700 includes a processor 702, which may be also be referenced as a central processor unit (CPU). The processor 702 may communicate and/or provide instructions to other components within the system 700, such as the input interface 704, output interface 706, and/or memory 708. In one embodiment, the processor 702 may include one or more multi-core processors and/or memory (e.g., cache memory) that function as buffers and/or storage for data. In alternative embodiments, processor 702 may be part of one or more other processing components, such as application specific integrated circuits (ASICs), field-programmable gate arrays (FPGAs), and/or digital signal processors (DSPs). Although FIG. 7 illustrates that processor 702 may be a single processor, it will be understood that processor 702 is not so limited and instead may represent a plurality of processors including massively parallel implementations and processing graphs comprising mathematical operators connected by data streams. The processor 702 may be configured to implement any of the methods described herein.

FIG. 7 illustrates that memory 708 may be operatively coupled to processor 702. Memory 708 may be a non-transitory medium configured to store various types of data. For example, memory 708 may include one or more memory devices that comprise secondary storage, read-only memory (ROM), and/or random-access memory (RAM). The secondary storage is typically comprised of one or more disk drives, optical drives, solid-state drives (SSDs), and/or tape drives and is used for non-volatile storage of data. In certain instances, the secondary storage may be used to store overflow data if the allocated RAM is not large enough to hold all working data. The secondary storage may also be used to store programs that are loaded into the RAM when such programs are selected for execution. The ROM is used to store instructions and perhaps data that are read during program execution. The ROM is a non-volatile memory device that typically has a small memory capacity relative to the larger memory capacity of the secondary storage. The RAM is used to store volatile data and perhaps to store instructions.

As shown in FIG. 7, the memory 708 may be used to house the instructions for carrying out various embodiments described herein. In an embodiment, the memory 708 may comprise a computer program module 710 that may be accessed and implemented by processor 702. Alternatively, application interface 712 may be stored and accessed within memory by processor 702. Specifically, the program module or application interface may perform signal processing and/or conditioning of the time series data as described herein.

Programming and/or loading executable instructions onto memory 708 and processor 702 in order to transform the system 700 into a particular machine or apparatus that operates on time series data is well known in the art. Implementing instructions, real-time monitoring, and other functions by loading executable software into a computer can be converted to a hardware implementation by well-known design rules. For example, decisions between implementing a concept in software versus hardware may depend on a number of design choices that include stability of the design and numbers of units to be produced and issues involved in translating from the software domain to the hardware domain. Often a design may be developed and tested in a software form and subsequently transformed, by well-known design rules, to an equivalent hardware implementation in an ASIC or application specific hardware that hardwires the instructions of the software. In the same manner as a machine controlled by a new ASIC is a particular machine or apparatus, likewise a computer that has been programmed and/or loaded with executable instructions may be viewed as a particular machine or apparatus.

In addition, FIG. 7 illustrates that the processor 702 may be operatively coupled to an input interface 704 configured to obtain the time series data and output interface 706 configured to output and/or display the results or pass the results to other processing. The input interface 704 may be configured to obtain the time series data via sensors, cables, connectors, and/or communication protocols. In one embodiment, the input interface 704 may be a network interface that comprises a plurality of ports configured to receive and/or transmit time series data via a network. In particular, the network may transmit the acquired time series data via wired links, wireless link, and/or logical links. Other examples of the input interface 704 may be universal serial bus (USB) interfaces, CD-ROMs, DVD-ROMs. The output interface 706 may include, but is not limited to one or more connections for a graphic display (e.g., monitors) and/or a printing device that produces hard-copies of the generated results.

To further understand the power-loss model, a condition number (CN) provides a validation of how well posed, or sensitive, the power loss model is to changes in the bending function:

$$CN = \left|\frac{\text{relative changes in } P}{\text{relative changes in bending function}}\right| = \left|\tau \cdot \frac{1}{P} \cdot \frac{\partial P}{\partial \tau}\right|$$

-continued $$= \left| \frac{(\alpha \cdot z \cdot \gamma + \alpha \cdot \beta \cdot \tau \cdot z)}{\tau^{\gamma}} \cdot e^{-\beta \cdot \tau} \right|$$

$$= |\alpha \cdot z| \cdot \left| \frac{(\gamma + \beta \cdot \tau)}{\tau^{\gamma}} \cdot e^{-\beta \cdot \tau} \right|$$

where $|\alpha \cdot z|$ is a condition number for a non-dependent bending model, such as the standard attenuation model.

In one nonlimiting embodiment a process for determining real-time drilling operations dysfunctions measures a power-loss of signal propagation associated with a drill string, the process comprises acquiring a first time series from a mid-string drilling sub sensor associated with a drill string in a wellbore in a first well and acquiring a second time series from a sensor associated with the drill string wherein the sensor is on or near a drill rig on the surface of the earth. The process further comprises determining the geometry of the wellbore and determining model parameters alpha and beta for characterizing a wellbore using the first time series, the second time series and the geometry of the wellbore by deriving a power loss of signal propagation.

Other aspects may comprise drilling a second well wherein the drill string does not include mid string drilling sub units that acquire and send time series data into the drill string. A further aspect may comprise drilling a second well and acquiring a third time series from a sensor associated with a drill string in a wellbore wherein the sensor is on or near the drill rig on the surface of the earth. Drilling dysfunctions may be mitigated in drilling the second well, wherein the dysfunctions are determined using the determined model parameters alpha and beta, the third time series and geometry of the second wellbore. The process may further comprise deriving parameter gamma, that with alpha and beta characterize a power loss dysfunction of signal propagation for signal travelling through the drill string. Determining model parameters using the first and second time series may further comprise a two-step parameter estimation: (1) $\ln(P_{0,j}/P_{i,j})+a_i z_i=0$ for $i=1, 2, \ldots, N_z$; $j=1, 2, \ldots, N_s$ and (2) $a_i=\alpha e^{-\beta\tau_i}\tau_i^{-\gamma}$, being the three-parameter problem to account for combined slab/fiber effects where i is over depth and j indexes over survey stations. The process may further comprise determining, using alpha, beta and optionally gamma, at least one selected from the group of i) a geometrical tortuosity, ii) a cumulative dog-leg value, and iii) a clamping efficiency.

In another nonlimiting embodiment, a system is provided for determining real-time drilling operations dysfunctions by measuring power-loss of signal propagation associated with a drill string during drilling a wellbore where the system comprises a mid-string drilling sub sensor associated with a drill string in a wellbore in a first well for acquiring a first time series and a sensor associated with the first well drill string for acquiring a second time series wherein the sensor for acquiring the second time series is on a drilling rig or near the surface of the earth. A bottom hole assembly associated with the drill string provides data to determine a geometry of the first wellbore, while a computer with a processor and memory further comprises a first computer program module to determine model parameters alpha and beta that characterize a wellbore using the first time series, the second time series and the geometry of the wellbore by deriving a power loss of signal propagation.

In other aspects, the system may further comprise a second well drill string wherein the drill string does not include mid string drilling sub units that acquire and send time series data into the drill string. Also, the system may comprise a second well drill string associated sensor wherein the sensor is on or near the surface of the earth to provide data for determining the dynamic state of the second well drill string in the wellbore from a third time series data acquired from the sensor combined with the determined model parameters. The system may further comprise a second computer program module for determining drilling dysfunctions in drilling the second well, dysfunctions determined using the determined model parameters, the third time series and geometry of the second wellbore. A third computer program module may be provided for mitigating the drilling dysfunctions in drilling the second well. A fourth computer program module may be provided that determines a parameter gamma, that with alpha and beta may be used to characterize a power loss dysfunction of signal propagation for signal travelling through the drill string.

In still further nonlimiting embodiments a drilling rig apparatus is provided for drilling multiple wells, where the apparatus comprises a drill rig with a first drill string for drilling a first well and a mid-string drilling sub sensor associated with the drill string for acquiring a first time series, as well as a second sensor associated with the drill string wherein the second sensor is on or near the drill rig at the surface of the earth, the second sensor for acquiring a second time series. Also provided is a bottom hole assembly associated with the drill string to provide data to determine a geometry of a wellbore. A computer with a processor and memory may be provided, which has one or more application interfaces and one or more computer program modules. A first computer program module may be provided for determining model parameters, using the first time series, the second time series and the geometry of the wellbore to derive model parameters alpha and beta that characterize a power loss of signal propagation for signal travelling through the drill string.

In other aspects the apparatus may further comprise a second well drill string wherein the drill string does not include mid string drilling sub units that acquire and send time series data into the second drill string. Also, the apparatus may comprise a bottom hole assembly associated with the second drill string providing data to determine a geometry of a second wellbore. Further, a second well drill string associated sensor may be provided wherein the sensor is on or near the drill rig at the surface of the earth to acquire a third time series. A second computer program module may be provided that determines parameter gamma that with alpha and beta may be used to characterize a power loss dysfunction of signal propagation for signal travelling through the first or second drill string. A dysfunction-detection computer program module may be provided for determining a dynamic state of the second drill string in a wellbore. A dysfunction-mitigation computer program module may be provided for mitigating drilling dysfunctions detected associated with a drill string in a wellbore.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process for determining real-time dysfunctions by measuring power-loss of signal propagation associated with a drill string for drilling a wellbore, the process comprising:

acquiring a first time series from a mid-string drilling sub sensor associated with the drill string in the wellbore in a first well;

acquiring a second time series from a sensor associated with the drill string, the sensor positioned at a surface of the earth;

determining geometry of the wellbore;

determining a first model parameter, a second model parameter, and a third model parameter for characterizing the wellbore using the first time series, the second time series, and the geometry of the wellbore by deriving a power loss of signal propagation; and mitigating a drilling dysfunction while drilling another well, the drilling dysfunction determined using at least the first model parameter and the second model parameter.

2. The process of claim 1, wherein the another well includes another drill string without any mid-string drilling sub sensors that acquire and send time series data to the another drill string.

3. The process of claim 1, further comprising:

acquiring, while drilling the another well, a third time series from another sensor associated with another drill string in another wellbore, the another sensor positioned on the surface.

4. The process of claim 3, wherein the drilling dysfunction is further determined using the third time series and geometry of the another wellbore.

5. The process of claim 1, further comprising:

determining, using the first model parameter and the second model parameter, one or more of geometrical tortuosity, a cumulative dog-leg value, and clamping efficiency.

6. The process of claim 1, wherein the determining the first model parameter and the second model parameter includes a two-step parameter estimation:

$$(1)\ \ln(P_{0,j}/P_{i,j})+a_i z_i=0 \text{ for } i=1, 2, \ldots, N_z;\ j=1, 2, \ldots, N_s \text{ and } (2)\ a_i=\alpha e^{-\beta\tau_i}\tau_i^{-\gamma},$$

being a three-parameter problem to account for combined slab and fiber effects, where P is power loss, a is propagation of signal strength, z is depth, $\alpha$ is the first model parameter, $\beta$ is the second model parameter, $\gamma$ is the third model parameter, i is over depth, $_T$ is clamping efficiency, and j indexes over survey stations.

7. The process of claim 1, further comprising:

determining, using the first model parameter, the second model parameter, and the third model parameter, at least one of: a geometrical tortuosity, a cumulative dog-leg value, or a clamping efficiency.

8. A system for determining real-time dysfunctions by measuring power-loss of signal propagation, the system comprising:

a mid-string drilling sub sensor associated with a first well drill string in a first wellbore in a first well for acquiring a first time series;

a sensor associated with the first well drill string for acquiring a second time series, the sensor positioned on a surface of the earth;

a bottom hole assembly associated with the first well drill string to provide data to determine a geometry of the first wellbore; and a computer comprising a memory, a processor, and one or more programs stored via the memory that, when executed by the processor, cause the computer to:

determine a first model parameter, a second model parameter, and a third model parameter that characterize the first wellbore using the first time series, the second time series and the geometry of the first wellbore by deriving a power loss of signal propagation, and mitigate a drilling dysfunction while drilling another well, the drilling dysfunction determined using at least the first model parameter and the second model parameter.

9. The system of claim 8, further comprising:

another drill string without any mid-string drilling sub sensors that acquire and send time series data to the another drill string.

10. The system of claim 8, further comprising:

another drill string having another sensor positioned on the surface, the another sensor configured to provide data for determining a dynamic state of the another drill string in another wellbore using a third time series data acquired from the another sensor combined with the first model parameter and the second model parameter.

11. The system of claim 10, wherein the drilling dysfunction is determined using the third time series and geometry of the another wellbore.

12. The system of claim 8, wherein the computer is configured, via the one or more programs, to determine one or more of geometrical tortuosity, a cumulative dog-leg value, and clamping efficiency.

13. The system of claim 8, wherein determining at least the first model parameter and the second model parameter includes a two-step parameter estimation:

$$(1)\ \ln(P_{0,j}/P_{i,j})+a_i z_i=0 \text{ for } i=1, 2, \ldots, N_z;\ j=1, 2, \ldots, N_s \text{ and } (2)\ a_i=\alpha e^{-\beta\tau_i}\tau_i^{-\gamma},$$

being a three-parameter problem to account for combined slab and fiber effects, where P is power loss, a is propagation of signal strength, z is depth, $\alpha$ is the first model parameter, $\beta$ is the second model parameter, $\gamma$ is the third model parameter, i is over depth, $_T$ is clamping efficiency, and j indexes over survey stations.

14. A drilling rig apparatus for drilling multiple wells, the apparatus comprising:

a drill rig with a first drill string for drilling a first well;

a mid-string drilling sub sensor associated with the first drill string for acquiring a first time series;

a second sensor associated with the first drill string, the second sensor positioned at a surface of the earth, the second sensor for acquiring a second time series;

a bottom hole assembly associated with the first drill string to provide data to determine a geometry of a wellbore; and a computer comprising a memory, a processor, and one or more programs stored via the memory that, when executed by the processor, cause the computer to:

determine a first model parameter, a second model parameter, and a third model parameter using the first time series, the second time series, and the geometry of the wellbore, the first model parameter, the second model parameter, and the third model parameter characterizing a power loss of signal propagation for a signal travelling through the first drill string, and mitigate a drilling dysfunction while drilling another well, the drilling dysfunction determined using at least the first model parameter and the second model parameter.

15. The apparatus of claim 14, further comprising:

another drill string without any mid-string drilling sub units that acquire and send time series data into the another drill string.

16. The apparatus of claim 14, further comprising:

another bottom hole assembly associated with another drill string to provide data to determine another geometry of another wellbore.

17. The apparatus of claim 14, further comprising:

another drill string having another sensor positioned at the surface to acquire a third time series.

18. The apparatus of claim 14, wherein determining at least the first model parameter and the second model parameter includes a two-step parameter estimation:

$$(1)\ln(P_{0,j}/P_{i,j})+a_i z_i=0 \text{ for } i=1, 2, \ldots, N_z;\ j=1, 2, \ldots, N_s \text{ and } (2)\ a_i=\alpha e^{-\beta\tau_i}\tau_i^{-\gamma},$$

being a three-parameter problem to account for combined slab and fiber effects, where P is power loss, a is propagation of signal strength, z is depth, $\alpha$ is the first model parameter, $\beta$ is the second model parameter, $\gamma$ is the third model parameter, i is over depth, $_T$ is clamping efficiency, and j indexes over survey stations.

19. The apparatus of claim 17, wherein the computer is configured, via the one or more programs, to determine a dynamic state of the another drill string in another wellbore.

20. The apparatus of claim 19, wherein the computer is configured, via the one or more programs, to determine one or more of geometrical tortuosity, a cumulative dog-leg value, and clamping efficiency.

* * * * *